US010208510B1

(12) United States Patent
Van Dyck

(10) Patent No.: US 10,208,510 B1
(45) Date of Patent: Feb. 19, 2019

(54) INTEGRAL POSITIVE UNLOCK DEVICE FOR DRAWER AND CABINET SAFETY LOCKS

(71) Applicant: Alex Van Dyck, Chicago, IL (US)

(72) Inventor: Alex Van Dyck, Chicago, IL (US)

( * ) Notice: Subject to any disclaimer, the term of this patent is extended or adjusted under 35 U.S.C. 154(b) by 0 days.

(21) Appl. No.: 15/982,221

(22) Filed: May 17, 2018

(51) Int. Cl.

| | |
|---|---|
| ***E05B 65/00*** | (2006.01) |
| ***E05B 63/18*** | (2006.01) |
| ***E05C 1/10*** | (2006.01) |
| ***E05B 65/46*** | (2017.01) |

(52) U.S. Cl.
CPC ..... *E05B 65/0014* (2013.01); *E05B 63/18* (2013.01); *E05B 65/46* (2013.01); *E05C 1/10* (2013.01)

(58) Field of Classification Search
CPC ..... Y10T 292/0911; Y10T 292/0926; Y10T 292/0918; Y10T 292/0934; Y10T 292/0951; Y10T 292/0952; Y10T 292/0953; Y10T 292/0954; Y10T 292/0957; Y10T 292/0959; Y10T 292/0997; Y10T 292/1022; Y10T 292/1023; Y10T 292/1024; Y10T 292/1025; Y10T 292/1028; Y10T 292/1031; E05B 65/0014; E05B 65/46; E05B 65/00; E05B 63/18; E05B 17/20; E05C 1/10; E05C 1/085; E05C 1/004; A47B 88/04; A47B 88/16; A47B 88/57; A47B 88/00; A47B 2210/0018
USPC ..... 312/334.47, 333, 334.46, 334.45, 334.44
See application file for complete search history.

(56) References Cited

U.S. PATENT DOCUMENTS

| | | | | | |
|---|---|---|---|---|---|
| 426,389 | A * | 4/1890 | Lacey | E05B 53/003 | 292/171 |
| 572,408 | A * | 12/1896 | Clarke | E05C 1/10 | 292/175 |
| 1,036,583 | A * | 8/1912 | Diedrich | E05B 65/025 | 292/153 |
| 1,046,336 | A * | 12/1912 | Schatz | E05B 83/243 | 292/108 |
| 4,139,249 | A * | 2/1979 | Hillman | E05B 65/0014 | 292/175 |

(Continued)

*Primary Examiner* — Alyson M Merlino
(74) *Attorney, Agent, or Firm* — Rockman Videbeck & O'Connor

(57) ABSTRACT

A latch assembly is provided for limiting movement of a first element, such as a drawer or door of a cabinet, relative to a second element in a first position of the latch assembly, and allowing non-restricted movement of the first element relative to the second element in a second position of the latch assembly. Abase plate is mounted to the first element, and a stop element is mounted to the second element. The latch assembly also comprises a latching plate reciprocally, vertically and moveably mounted on the base plate, such that the latching plate is moveable between a first vertical position engaging the stop element and a second vertical position where said latching plate is disengaged from said stop element. An unlock lever is pivotably mounted to the base plate, and the unlock lever is manually moveable from a first position out of engagement with the latching plate to a second position where the unlock lever secures the latching plate in its second vertical position. The latching plate remains unable to engage the stop element in the second vertical position of the latching plate.

4 Claims, 6 Drawing Sheets

(56) References Cited

U.S. PATENT DOCUMENTS

| | | | | | |
|---|---|---|---|---|---|
| 4,159,153 | A | | 6/1979 | Yoshikawa | |
| 4,416,477 | A | | 11/1983 | Bialobrzeski | |
| 4,647,088 | A | * | 3/1987 | Nelson | E05B 63/18 292/104 |
| 4,715,628 | A | * | 12/1987 | Brink | E05B 65/0014 292/19 |
| 5,147,099 | A | * | 9/1992 | McLinden | E05B 65/0014 292/152 |
| 5,344,226 | A | * | 9/1994 | Lee | A47B 88/57 292/163 |
| 5,445,451 | A | * | 8/1995 | Harmony | E05B 65/0014 292/19 |
| 5,626,372 | A | * | 5/1997 | Vogt | E05B 65/0014 292/87 |
| 5,769,517 | A | | 6/1998 | Carde | |
| 5,823,649 | A | | 10/1998 | Hinrichs | |
| 8,056,989 | B2 | * | 11/2011 | Zielinski | E05B 65/0014 292/84 |
| 8,419,080 | B2 | | 4/2013 | Levine | |
| 2003/0048050 | A1 | * | 3/2003 | Wong | E05B 65/0014 312/333 |

* cited by examiner

INTEGRAL POSITIVE UNLOCK DEVICE FOR DRAWER AND CABINET SAFETY LOCKS

TECHNICAL FIELD

The present invention relates to drawer and cabinet safety latches and locks, and in particular providing an unlock assembly to maintain the latch or lock in an unlocked position when desired.

BACKGROUND

Young children, by their nature, take pleasure in opening and closing drawers and cabinet doors and removing the contents of the drawer or cabinet. These drawers and cabinets may contain objects that should not be used by children as playthings, such as jewelry, chemicals that can be harmful if ingested, and other items that should be kept away from children. Several locking devices have been developed and used to lock and latch drawers and cabinets against access by children. See, for example, the disclosures in U.S. Pat. Nos. 5,445,451 and 5,626,372.

U.S. Pat. No. 5,626,372 discloses a drawer lock device having a pivotal spring-loaded mounting assembly for a rigid support arm, and for a flexible latching arm and abutment surface, where the support and latching arms are in a first locking position allowing the latching arm to engage a drawer stop member when the drawer is attempted to be opened. The support and latching arms can be pivoted to a second position where the support arm and latching arm assembly are disposed such that the latching arm assembly does not engage the stop member, allowing full opening of the drawer, such as when children are not present.

However, the mechanism disclosed in U.S. Pat. No. 5,626,372 requires a somewhat complicated and relatively expensive pivot structure mounting the support and latch arms to the inside of the front panel of the drawer. Further, over time, the flexible latching element could lose its inherent flexibility characteristics, causing the spring to be replaced.

Additionally, another drawback of the reference latch is that the entire latching or restraining member and its mounting structure must be pivoted to move the restraining member to the unengageable position (FIG. 2). Also, the restraining or latching arm member of the reference device is made of plastic and configured such that it deflects in spring-like fashion upon the application of finger pressure to the release lever. A second spring element is used to control pivotal deployment of the shaft upon which the restraining member is mounted. Also, when the restraining member of the reference device is in its engageable position, it extends horizontally into the drawer a sufficient distance to contact and interfere with the contents of the drawer. This will cause problems when the user attempts to pivot the restraining member from the engageable position, or vice versa.

U.S. Pat. No. 5,445,451 discloses a cabinet and drawer latch with dual flexible prongs having bulbous ends adapted to engage a stop anchor attached to a drawer or cabinet. The flexible prongs extend outward from a downwardly extending base plate, and the base plate is insertable into and retained in a pocket, the pocket firmly attached to the interior front panel of a drawer or cabinet. A detent assembly lodges the base plate firmly in the pocket. The U.S. Pat. No. 5,445,451, however, does not state that the dual flexible prongs and base plate could be easily or manually removed once installed in the pocket. The reference patent states that a narrow tool such as a screwdriver blade would be necessary to disengage the base plate and flexible prongs from the pocket. A further disadvantage of the device disclosed in the U.S. Pat. No. 5,455,451 is that once the base plate and flexible prongs are removed from the pocket, they may be separated from the latch assembly, and eventually lost or discarded. Clearly a single latching assembly having a locking and unlocking feature would be advantageous over the two-piece latch assembly disclosed in U.S. Pat. No. 5,445,451.

SUMMARY

A latch assembly is provided for limiting movement of a first element, such as a drawer or door of a cabinet, relative to a second element in a first position of the latch assembly, and allowing non-restricted movement of the first element relative to the second element in a second position of the latch assembly. The latch assembly includes a base plate mounted to the first element, and a stop element mounted to the second element. The latch assembly also comprises a latching plate reciprocally, vertically and moveably mounted on the base plate, such that the latching plate is moveable between a first vertical position engaging the stop element and a second vertical position where the latching plate is disengaged from the stop element. An unlock lever is pivotably mounted to the base plate, and the unlock lever is manually moveable from a first position out of engagement with the latching plate to a second position where the unlock lever secures the latching plate in its second vertical position. The latching plate remains unable to engage the stop element in the second vertical position of the latching plate.

These and other aspects of the present disclosure are disclosed in the following detailed description of the embodiments, the appended claims and the accompanying figures.

BRIEF DESCRIPTION OF THE DRAWINGS

The embodiments of the present invention will be described with greater specificity and clarity with reference to the following drawings, in which.

These drawings are illustrative of an embodiment of the presently disclosed apparatus, and are not to be considered as limitations on the scope of the claims appended hereto.

DESCRIPTION OF THE ILLUSTRATED EMBODIMENT

Figure 1:
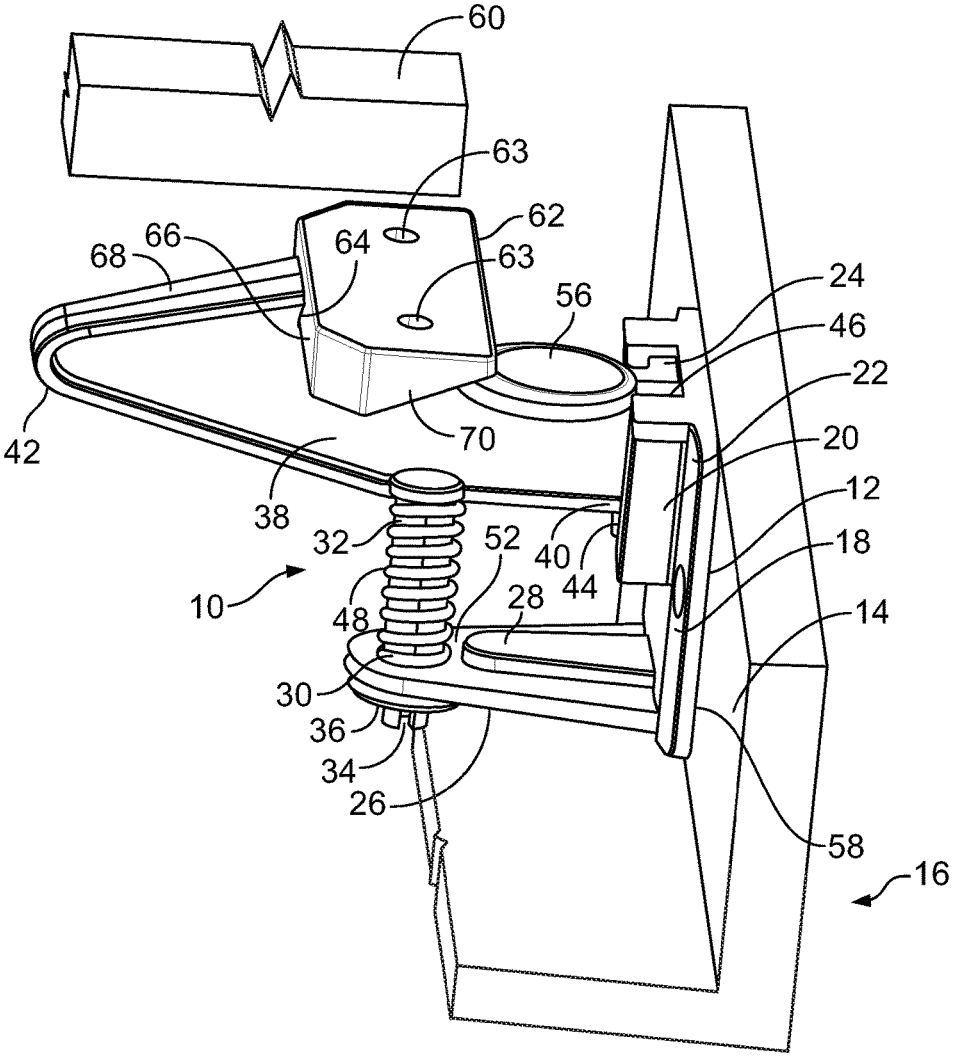
FIG. 1 PRIOR ART
FIG. 1 is a top front perspective view of a drawer locking assembly that is presently available, without an integral positive unlock feature, showing the locking assembly in a first locking position.
Figure 2:
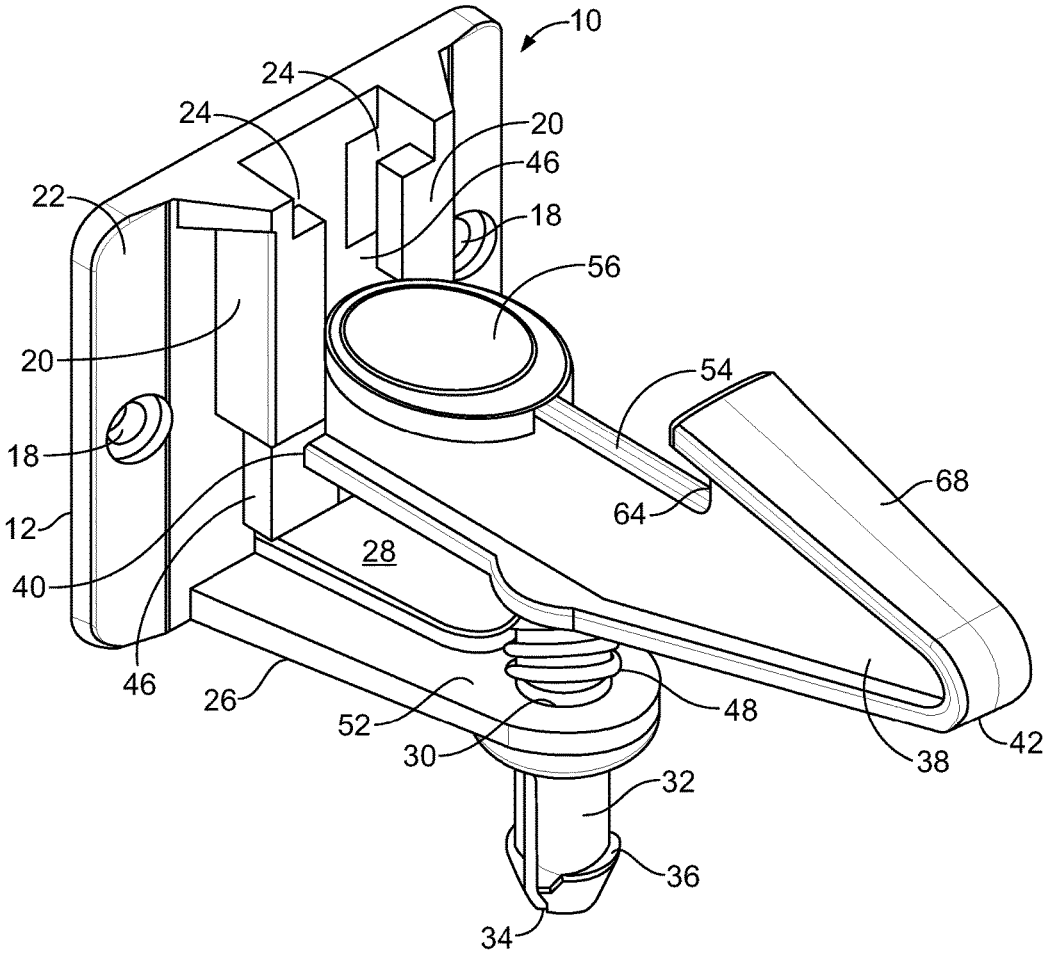
FIG. 2 PRIOR ART
FIG. 2 is a front side perspective view of the presently available drawer locking assembly of FIG. 1, showing the locking assembly in a second unlocked position.

FIGS. 1 and 2 illustrate presently available drawer and cabinet locks that do not include an integral positive unlock structure. The following description is made with reference to drawer locks. However, it is understood that the devices described below could just as well be used with cabinet doors.

FIGS. 1 and 2 illustrate a child-proof drawer lock currently on the market, and of which the present disclosure is an improvement. A latching assembly generally designated as 10 includes a base plate 12 attached to the inside front panel 14 of a laterally slideable drawer 16. Base plate 12 includes apertures 18 adapted to receive screws to attach base plate 12 to panel 14 of drawer 16. Alternatively, base plate 12 can be attached to panel 14 by a relatively strong adhesive, or any other attachment device as is known in the art.

A pair of opposed vertically extending L-shaped flanges 20 are formed on front face 22 of base plate 12, providing a channel 24 for purposes to be explained. A lower support plate 26 and a lower support plate reinforcing member 28 are firmly attached to, or may form a part of, base plate 12. Lower support plate 26 extends laterally outward from base plate 12, and includes aperture 30 extending through the lower support plate 26. Shaft 32 slidably extends through aperture 30 such that vertical movement is freely provided between shaft 32 and aperture 30. The lower end of shaft 32 includes a notch 34 permitting shaft 32 to be radially compressed and inserted into aperture 30 when assembling the latching assembly 10. An outwardly radially extending flange 36 is disposed adjacent notch 34 for the purpose of preventing shaft 32 from being removed once the shaft is inserted into aperture 30.

Figure 4:
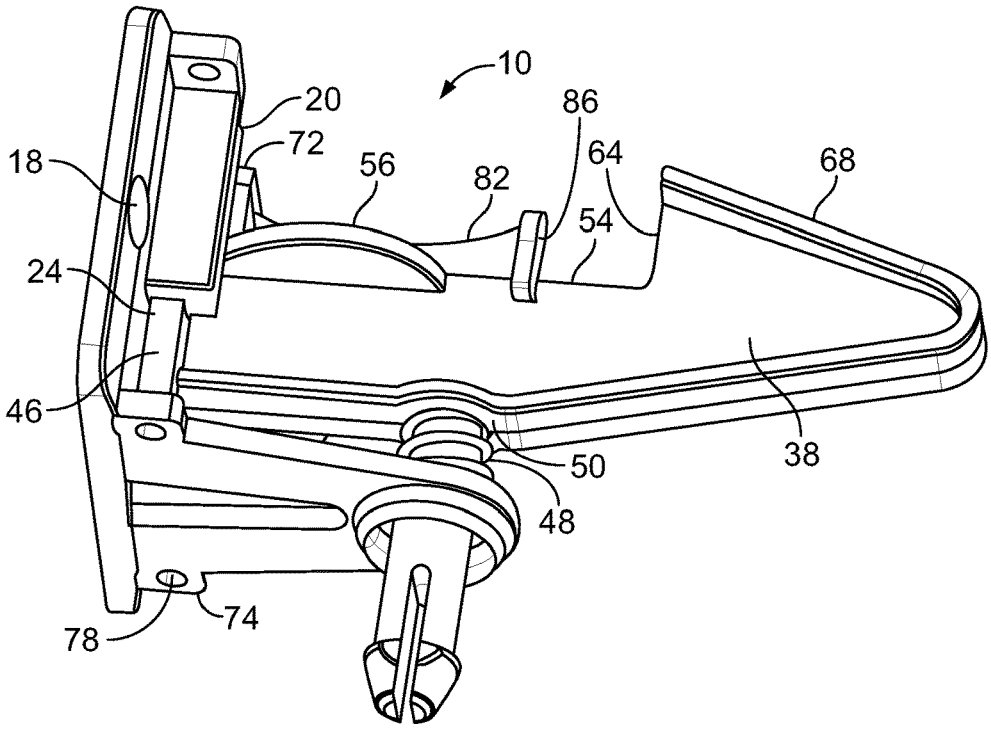
FIG. 4 is a bottom side perspective view of the drawer locking assembly of FIG. 3, showing the integral positive unlock structure in a second operative position.
Figure 5:
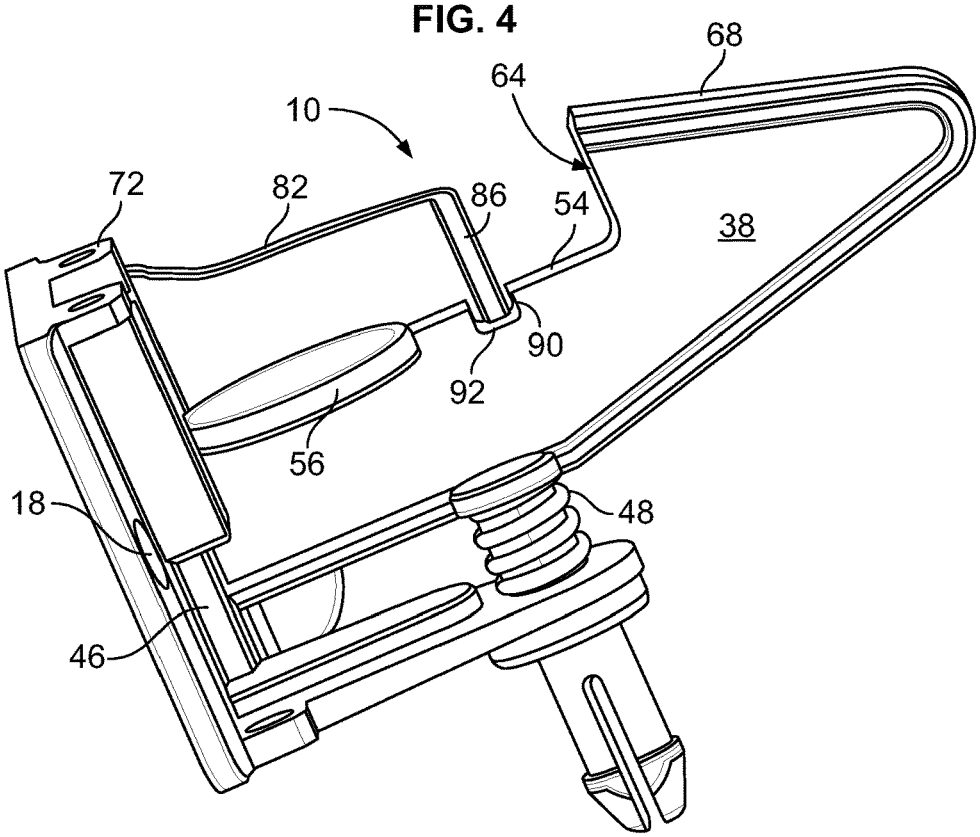
FIG. 5 is a top side perspective view of the drawer locking assembly of FIGS. 3 and 4 showing the integral positive unlock structure in the second operative position.

Attached to or forming part of the upper portion of shaft 32 is a latching plate 38, having an inner end 40 and an outer end 42. The inner end 40 comprises opposed laterally outwardly extending flanges 44, 46 (FIG. 1, 6). Flanges 44, 46 are vertically slidably disposed in channel 24 of base plate 12, permitting flanges 44, 46 and latching plate 38 freedom of vertical movement relative to base plate 12. A compression spring 48 coils around shaft 32, and extends between the underside 50 (FIG. 4) of latching plate 38 and the upper surface 52 of lower support plate 26.

The upper surface 54 (FIG. 2) of latching plate 38 mounts a finger pressure plate 56. Compression spring 48 forces latching plate 38 into the upward position in channels 24, as shown in FIG. 1 when no finger pressure is applied to pressure plate 56. Upon the application of downward finger pressure to plate 56, latching plate 38 moves downward in channels 24. The compression force of spring 48 is selected such that the finger pressure applied by an infant or toddler to plate 56 would be insufficient to move shaft 32 and latching plate 38 downward against the force of spring 48. However, finger pressure applied by an adult would be sufficient to drive shaft 32 and latching plate 38 downward.

Referring to FIG. 1, the rear face 58 of base plate 12 is firmly attached to the inside of front panel 14 of slidable drawer 16. A frame portion 60 of the cabinet in which drawer 16 is slidably installed includes a downwardly extending stop element 62 attached to frame portion 60 of the cabinet by means of screws or nails inserted through apertures 63, or by a suitable adhesive. Latching plate 38 includes a vertically extending flange 64 that firmly engages surface 66 of stop element 62 when drawer 16 is slid out of the cabinet a short distance, as shown in FIG. 1.

If an infant or toddler slides drawer 16 out of the cabinet frame portion 60, latching plate 38 advance horizontally until vertically extending flange 64 contacts surface 66 of stop element 62, preventing further opening of drawer 16. Since compression spring 48 is strong enough to prevent an infant or toddler from forcing latching plate 38 and shaft 32 downward, the infant or toddler cannot open drawer 16 enough to access the interior of the drawer.

If an adult desires to gain access to the contents of drawer 16, the drawer is slid open to the position shown in FIG. 1 until flange 64 contacts surface 66 of stop element 62, exposing finger pressure plate 56 to the adult through the small drawer opening. Finger pressure is then applied to plate 56, and flanges 44, 46 move downward in channels 24. Latching plate 38 is attached to flanges 44, 46 and also moves downward, disengaging flange 64 from stop element 62. The drawer 16 can then be opened fully as the adult retains finger pressure on pressure plate 56. Once latching assembly 10 has passed the front opening of the cabinet, pressure on plate 56 is released and spring 48 drives latching plate upward, but flange 64 of latching plate 38 is well beyond stop element 66, and the drawer is free to move laterally.

To re-close and latch drawer 16, the drawer is moved laterally inward. As latching assembly 10 approaches the cabinet frame portion 60, slanted surface 68 of latching plate 38 engages lower slanted surface 70 of stop element 62. Latching plate 38 is forced downward against the pressure of spring 48 as spring 48 is compressed until vertically extending flange 64 is co-planer with surface 66 of stop element 62. Latching plate 38 then is driven upward by compressed spring 48 so that vertically extending flange 64 engages surface 66 of stop element 62, and drawer 16 is again locked against movement in the cabinet.

From the above explanation, it is apparent that upon closing drawer 16, the drawer automatically becomes locked in its closed position, and no provision is made in the described device for keeping the drawer unlocked and accessible when infants and toddlers are not present. The presently disclosed device was created to solve this problem. In the following description, corresponding elements in FIGS. 3-8 that are identified in FIGS. 1 and 2 are designated with the same numerals.

Referring first to FIGS. 3-8, base plate 12 of latching assembly 10 includes an upper flange 72 and a lower flange 74, with apertures 76, 78 extending co-axially through flanges 72, 74, respectively.

Figure 6:
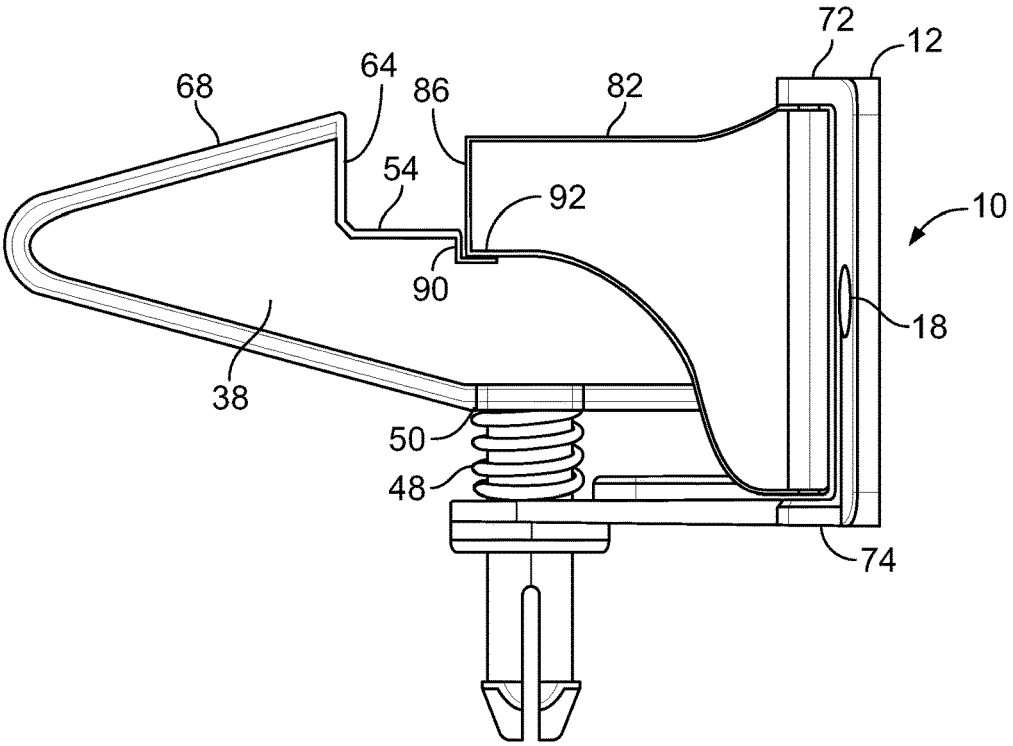
FIG. 6 is a side elevation view of the latch assembly of FIGS. 3, 4 and 5 showing the integral positive unlock structure in the second operative position.
Figure 7:
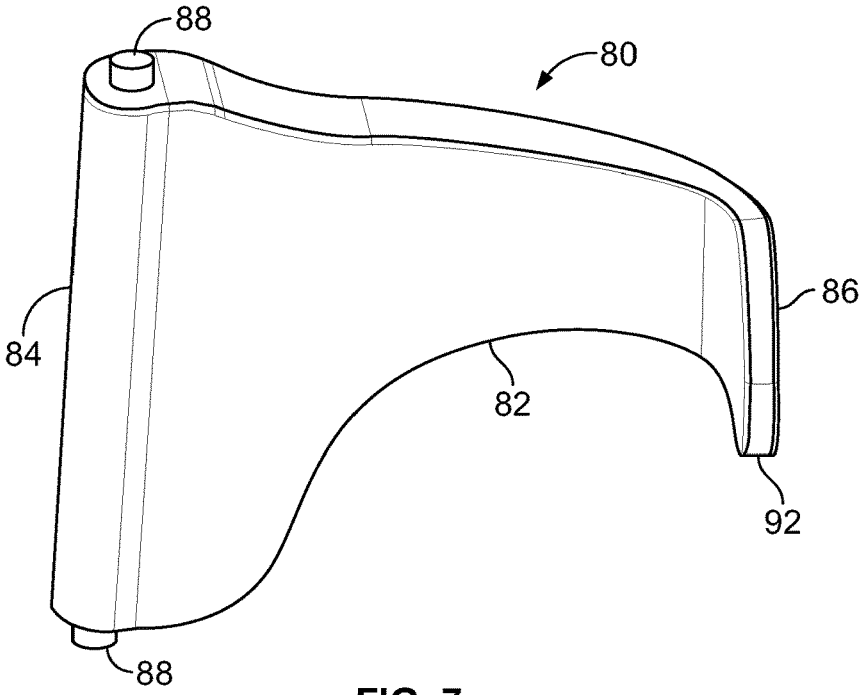
FIG. 7 is a detail perspective view of the integral positive unlock lever of the present disclosure.
Figure 8:
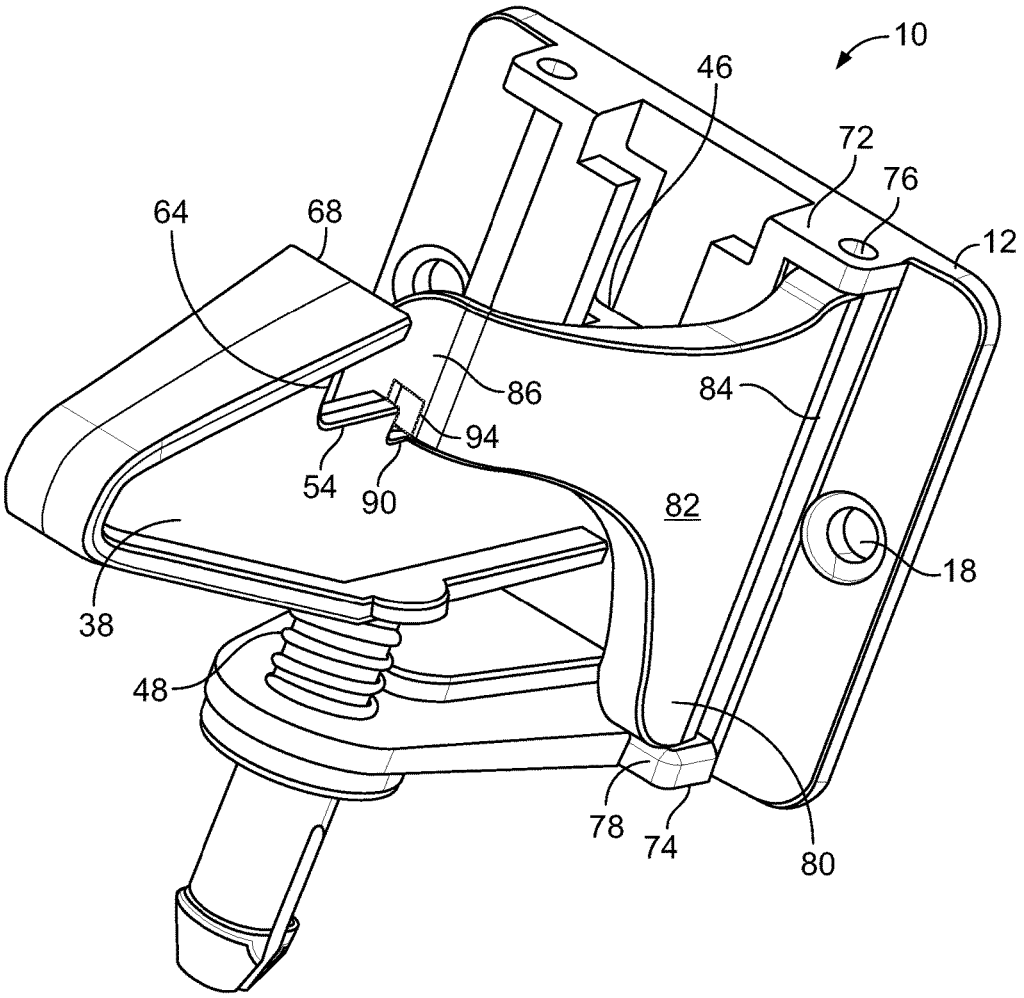
FIG. 8 is a top front side perspective view of the drawer locking assembly of the present disclosure, showing the integral positive unlock lever in its second operative position.

FIG. 7 is a detailed illustration of a positive unlock lever 80 comprising a body 82 with a longitudinally-extending semicircular portion 84 at one end, and an unlock flange 86 extending outwardly from the opposite end of body 82. A pair of cylindrical nubs 88 are located on either end of cylindrical portion 84 of body 82. As seen in FIGS. 6 and 8, nubs 88 are adapted to extend into apertures 76 and 78, enabling unlock lever 80 to be pivotally mounted on base plate 12. In the disclosed embodiment, unlock lever 80 is integrally positively mounted on base plate 12, such that unlock lever has approximately ninety degrees of freedom of movement, and can be easily rotated under manual pressure.

Figure 3:
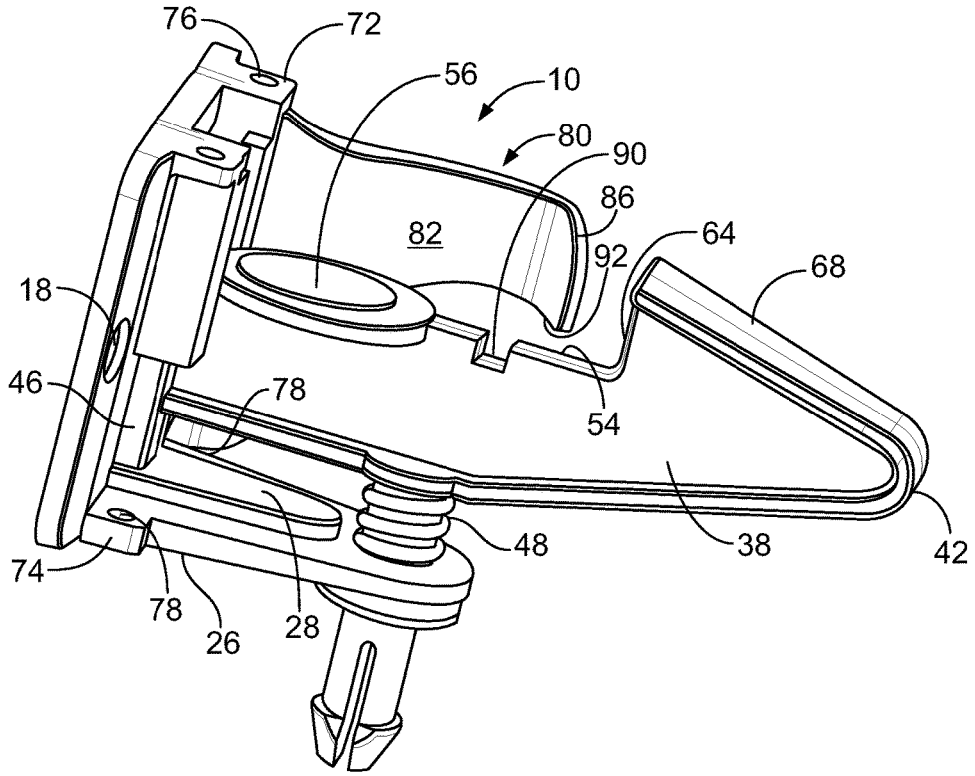
FIG. 3 is a top side perspective view of a drawer locking assembly including an integral positive unlock structure in accordance with the present disclosure, showing the integral positive unlock structure in a first inoperative position.

Referring to FIGS. 3-6 and 8, a notch 90 is embedded in upper surface 54 of latching plate 38. As seen in FIG. 3, flange 86 is in a first pivotally outward position where the bottom surface 92 of flange 86 is disengaged from notch 90.

FIGS. 4-6 and 8 illustrate the condition of latching assembly 10 where flange 86 is inserted into notch 90, and bottom surface 92 of flange 86 is in firm engagement with notch 90. In each of FIGS. 4-6 and 8, latching plate 38 is in its downward, or unlocked, position, where vertically extending flange 64 is disengaged from surface 66 of stop element 62, and drawer 16 is fully slidable in cabinet portion 60.

In operation, with reference to FIGS. 1, and 3-8, latching plate 38 is initially held in its upward position in channel 24 of base plate 12 under the force of spring 48, with surface 64 of the latching plate in engagement with surface 64 of stop element 62. In this position of latching plate 38, drawer 16 can be slid open a small amount and no further, and shown in FIG. 1.

A toddler or small child who opened the drawer 16 is unable to reach through the open space and remove objects in the drawer. Also, as mentioned above, spring 48 is strong enough to prevent a toddler or small child from contacting finger pressure plate 56 and pushing latching plate 38 to its downward position against the force of spring 48. However, latching plate 38 can be moved to its downward position by an adult placing their hand through the partially open drawer, and pressing down on finger pressure plate 56 until vertical surface 64 disengages from surface 66 of stop element 62. The drawer can then be further opened to any desired position.

If it is desired to disable the locking feature of latching assembly 10, such as when infants, toddlers and small children will not be present, the user moves the latching plate to its downward position after opening the drawer 16 a slight amount, and then pivots unlock lever 80 towards latching plate 38 while the latching plate is in its downward position until unlock flange 86 extends into notch 90 and bottom surface 92 of unlock lever 80 is in firm contact with the bottom of notch 90. With unlock lever 80 in this position, latching plate 38 is positively held in its downward or deactivated position relative to base plate 12 and out of engagement with stop element 62, and drawer 16 can be moved to its fully open or closed position at any time.

To re-activate latching plate 38 to its drawer locking, with the drawer 16 in an open position, an adult applies downward finger pressure to plate 56 and simultaneously laterally pivots unlock lever 80 such that flange 86 disengages from notch 90. Latching plate 38 is then allowed to move to its upper position in channel 24 under the force of spring 48. When the drawer 16 is moved to its closed position, the latching plate 38 is again in position to engage stop element 62 when drawer 16 is slightly open, preventing further opening of the drawer.

In a further embodiment of the present disclosure referring to FIG. 8, a notch or indentation 94 can be located at the bottom of unlock flange 86 to provide an additional locking relationship between unlock lever 82 and latching plate 38.

The foregoing description of an illustrated embodiment of the disclosed device has been presented for purposes of illustration and description, and is not intended to be exhaustive or to limit the invention to the precise form disclosed. The description was selected to best explain the principles of the disclosed device and practical application of these principles to enable others skilled in the art to best utilize the invention in various embodiments and various modifications as are suited to the particular use contemplated. It is intended that the scope of the invention not be limited by the specification, but be defined by the claims set forth below.

What is claimed is:

1. A latch assembly for limiting movement of a first moveable element relative to a second stationary element, said first moveable element inserted into and variably positionable relative to said second stationary element, said latching assembly having a first state providing a restricted opening between said first moveable element and said second stationary element, said latching assembly having a second state providing a non-restricted opening between said first moveable element and said second stationary element, said latch assembly comprising:

a base plate adapted to be mounted to said first moveable element, said base plate including opposed flanges forming a pair of parallel vertical channels;

said base plate including a lower support plate extending laterally from said base plate, an aperture disposed in said lower support plate;

a shaft extending through and moveable in said aperture;

a latching plate mounted on an upper end of said shaft, a compression force element extending between said latching plate and said lower support plate;

said compression force element engaging said latching plate and biasing said latching plate in a direction away from said lower support plate;

said latching plate comprising a first vertically extending flange;

a stop element adapted to be mounted on said second stationary element in a fixed position on said second stationary element;

said latching plate further comprising a pair of second vertically extending flanges vertically moveable in said parallel vertical channels of said base plate;

said latching plate and said shaft manually movable between a first vertical position in which said vertically extending flange of said latching plate engages said stop element, and a second vertical position in which said latching plate is disengaged from said stop element;

said engagement between said first vertically extending flange of said latching plate and said stop element adapted to define said restricted opening between said first moveable element and said second stationary element;

a manual pressure element formed on an upper surface of said latching plate, an application of manual pressure a predetermined amount moves said latching plate from said first vertical position to said second vertical position;

an unlock lever pivotally mounted to said base plate, said unlock lever movable between a first position in which said unlock lever is disengaged from said latching plate, to a second position engaging said latching plate when said latching plate is in its second vertical position, said unlock lever, when in said second position, is adapted to provide said non-restricted opening between said first moveable element and said second stationary element;

said unlock lever adapted to provide said restricted opening between said first moveable element and said second stationary element when said unlock lever is in said first position, and access to said manual pressure element is provided through said restricted opening when said unlock lever is disengaged from said latching plate.

2. The latch assembly of claim 1, further comprising:

an unlock flange extending outwardly from said unlock lever;

a notch disposed in said latching plate;

said unlock flange extending into said notch when said latching plate is in said second vertical position, and said unlock lever is in said second position.

3. The latch assembly of claim 2, wherein:

a lower surface of said unlock flange includes an additional notch, said additional notch engaging and nesting in said notch on said latching plate when said latching plate is in said first vertical position and said unlock lever is in said second position.

4. The latch assembly of claim 1, wherein:

said base plate comprises spaced apart upper and lower opposed flanges extending outward from said base plate adjacent to said latching plate;

axially aligned apertures extending through each of said upper and lower opposed flanges:

said unlock lever comprising a pair of axially aligned nubs protruding outwardly from said unlock lever, each of said nubs extending into a corresponding one of said apertures in said upper and lower opposed flanges, such that said unlock lever is pivotally mounted to said base plate.

* * * * *